US012644359B2

(12) United States Patent
Wiesenborn et al.

(10) Patent No.: US 12,644,359 B2
(45) Date of Patent: Jun. 2, 2026

(54) MILLING AND DEBRIS COLLECTING WITH MULTIPHASE VACUUM PUMP

(71) Applicant: Schlumberger Technology Corporation, Sugar Land, TX (US)

(72) Inventors: Robert Kyle Wiesenborn, Sugar Land, TX (US); Kean Wee Cheah, Singapore (SG); Kim Hoo Goh, Singapore (SG); Rishi Mishra, Sugar Land, TX (US); Idalia Ovalle Stevenson, Sugar Land, TX (US); Dan Neal Tabalan, Sugar Land, TX (US); Timothy Osmond, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/136,872

(22) PCT Filed: Dec. 19, 2023

(86) PCT No.: PCT/US2023/084887
§ 371 (c)(1),
(2) Date: Jun. 7, 2025

(87) PCT Pub. No.: WO2024/137667
PCT Pub. Date: Jun. 27, 2024

(65) Prior Publication Data

US 2025/0361794 A1 Nov. 27, 2025

Related U.S. Application Data

(60) Provisional application No. 63/387,983, filed on Dec. 19, 2022.

(51) Int. Cl.
*E21B 37/00* (2006.01)
*E21B 27/00* (2006.01)
(Continued)

(52) U.S. Cl.
CPC ..... *E21B 37/00* (2013.01); *E21B 27/005* (2013.01); *E21B 29/002* (2013.01); *E21B 34/06* (2013.01);
(Continued)

(58) Field of Classification Search
CPC ..... E21B 37/00; E21B 27/00; E21B 27/005; E21B 27/02
See application file for complete search history.

(56) References Cited

U.S. PATENT DOCUMENTS 4,252,190 A * 2/1981 Jageler ..... E21B 19/22 166/368
4,554,982 A 11/1985 Burton
(Continued)

*Primary Examiner* — David Carroll

(57) ABSTRACT

Systems and methods are disclosed herein for simultaneously milling an obstructions and collecting the resulting debris within a wellbore in an oil-and-gas setting. An example debris collection tool can include a motor, centrifugal pump, gear boxes, bailers, and a pass-through milling bit. A series of shafts can pass through the internal components of the tool and cause various components to rotate when driven by the motor. The gear boxes can lower the speed and increase the torque of rotating downhole components. The tool therefore can simultaneously drive the pump and milling bit at different speeds and torques. The centrifugal pump can include a flow control mechanism at allows the tool to control the flow of drilling fluid from the centrifugal pump into the surrounding subsurface.

20 Claims, 6 Drawing Sheets

(51) Int. Cl.

| | |
|---|---|
| ***E21B 29/00*** | (2006.01) |
| ***E21B 34/06*** | (2006.01) |
| ***F04D 17/08*** | (2006.01) |
| ***F04D 25/06*** | (2006.01) |
| ***F04D 29/22*** | (2006.01) |
| *E21B 47/09* | (2012.01) |

(52) U.S. Cl.
CPC ..... *F04D 17/08* (2013.01); *F04D 25/0686* (2013.01); *F04D 29/22* (2013.01); *E21B 47/09* (2013.01)

(56) References Cited

U.S. PATENT DOCUMENTS

| | | | | |
|---|---|---|---|---|
| 8,800,660 | B2 * | 8/2014 | Fishbeck | E21B 31/06 166/99 |
| 9,284,818 | B2 | 3/2016 | Hallundbæk | |
| 12,345,111 | B1 * | 7/2025 | Mishra | E21B 7/006 |
| 2007/0056773 | A1 * | 3/2007 | Booth | E21B 21/00 175/57 |
| 2010/0018775 | A1 * | 1/2010 | Hallundbaek | E21B 27/005 175/94 |
| 2012/0211220 | A1 * | 8/2012 | Ghazi-Moradi | E21B 23/01 166/117.7 |
| 2018/0073317 | A1 * | 3/2018 | Haugland | E21B 37/02 |
| 2018/0223625 | A1 | 8/2018 | Noel | |
| 2020/0072226 | A1 * | 3/2020 | Rivera Villarreal | F04D 31/00 |
| 2020/0300049 | A1 * | 9/2020 | Edvardsen | E21B 27/04 |
| 2021/0396097 | A1 * | 12/2021 | Tiwari | E21B 37/00 |
| 2022/0195847 | A1 | 6/2022 | Redmond | |

* cited by examiner

MILLING AND DEBRIS COLLECTING WITH MULTIPHASE VACUUM PUMP

CROSS-REFERENCE TO RELATED APPLICATION

This application claims priority to U.S. Provisional Patent Application No. 63/387,983, filed on Dec. 19, 2022, which is incorporated by reference herein.

BACKGROUND

The present disclosure is related in general to a downhole vacuum tool in well production for milling and removing debris.

Sometimes hydrocarbon wells get blocked with a variety of obstructions which prevent access to features (valves, plugs, etc.) or inhibit the production of the well. In the process of extracting wellbore fluid, such as oil, water, or gas, it is often necessary to remove debris from the well, such as viscous slurries, large solids, and sediment. Debris removal tools are used to complete such a task. Debris removal tools generally include a pump to pull in wellbore fluid and debris, and multiple internal components for capturing the debris. Current debris removal tools typically use Progressive Cavity Pumps ("PCP"). PCPs transfer fluid through a sequence of small, fixed shape, discrete cavities, as its rotor is turned. In a conventional well production system, production flow rate at the surface is of utmost importance. The maximum volumetric flow rate of a PCP, however, is limited to the proportion of the rotation rate and low levels of shearing being applied to the pumped fluid.

PCPs have another disadvantage as well. For example, PCPs have elastomeric stators that are susceptible to swelling and corrosion, which can shorten the run life of the PCP. PCPs frequently experience poor handling of high fraction of gas in the production fluid stream, which often causes gas lock. PCPs can lock up then left sitting idle for an extended period of time. PCPs also require multiple rotor sizes to accommodate different wellbore pressure and temperature environment.

As a result, a need exists for new and improved methods of downhole obstruction milling and debris removal. Wireline intervention methods exist for milling the obstruction and in a separate well run collecting the debris. This presents a unique and improved method for simultaneously milling and collecting the debris. It is against this backdrop that the disclosed embodiments are described herein.

SUMMARY

Systems and methods are disclosed herein for simultaneously performing downhole obstruction milling and debris removal within a wellbore in an oil-and-gas setting.

An example system can include a tool consisting of an electric motor driving a centrifugal pump. The centrifugal pump connects to a shaft and gear boxes that lower the speed and increase the torque. The gear boxes connect to a shaft that is located inside a bailer container and connects to a milling bit. As the electric motor turns, so do the pump and milling bit.

The wireline tool is conveyed via wireline tractor to the position in the well. Once the obstruction blocking the well is reached the milling and collecting tool is activated. The milling bit loosens the debris and the suction created by the bailer by the centrifugal pump pulls the debris into the bailer. A filter in the bailer separates the debris from the liquid. The debris is captured inside the bailer. The filtered liquid gets pumps back into the wellbore through the outlet of the centrifugal pump. As a result, circulation occurs around the tool in the wellbore.

The tool can include a check valve nose, a large debris bailer for coarse particle collection, and a fine debris filter for fine particle collection. The tool can also include a centrifugal pump for lifting the wellbore fluid. The tool can also include a flow control mechanism for controlling the wellbore fluid flow rate.

The check valve nose can prevent backflow of fluid or debris that enters the debris removal tool. For example, the check valve nose can be a one-way valve in which fluid can run freely into the tool, but the check valve nose closes if the fluid or debris begins to flow out of the tool.

The large debris bailer can collect larger debris that enter the tool, such as viscous slurries and large solids. The fine debris filter can use filters to capture fine debris and retain the fine debris in housing components. The centrifugal pump can be any type of centrifugal pump suitable for pumping wellbore fluid. For example, the centrifugal pump can be an Electrical Submersible Pump (ESP). The centrifugal pump can include multiple centrifugal stages that are stacked in series.

To help control wellbore fluid flow rates, the tool can include a flow control mechanism. The flow control mechanism can include a discharge housing with one or more discharge openings, a movement sleeve, and a motor that repositions the movement sleeve to cover more or less of the discharge opening(s) to adjust the flow rate. In one example, the discharge opening can be a linear cut slot, the movement sleeve can be a linear movement sleeve, and the motor can be a linear motor. To adjust the flow rate, the linear motor can adjust the movement sleeve to cover more or less of the linear cut slot to increase or decrease the size of the discharge opening. In another example, the discharge opening can include multiple discharge openings, the movement sleeve can be a linear movement sleeve, and the motor can be a linear motor. To adjust the flow rate, the linear motor can adjust the movement sleeve to cover more or fewer of the discharge openings to increase or decrease the amount of discharge openings through which the wellbore fluid can pass. In another example, the discharge sleeve can include multiple discharge openings, the movement sleeve can be a rotating sleeve, and the motor can be a stepper motor. To adjust the flow rate, the stepper motor can rotate the rotating sleeve to cover more or less of each of the discharge openings.

In one example, sensors can be used to measure the flow rate. A control unit can automatically send instructions to the flow control mechanism to adjust the movement sleeve if the flow rate falls outside of predetermined parameters. In one example, the control unit can display the flow rate, and a user can manually set the adjustments for the flow control mechanism.

The methods herein can be incorporated into a non-transitory, computer-readable medium. The medium can include instructions that, when executed by a hardware-based processor of a computing device, perform various stages as described in the example methods herein.

This summary section is not intended to give a full description of the disclosed systems and methods.

BRIEF DESCRIPTION OF THE DRAWINGS

The embodiments of the present invention are illustrated by way of example, and not by way of limitation, in the figures of the accompanying drawings and in which like reference numerals refer to similar elements. The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
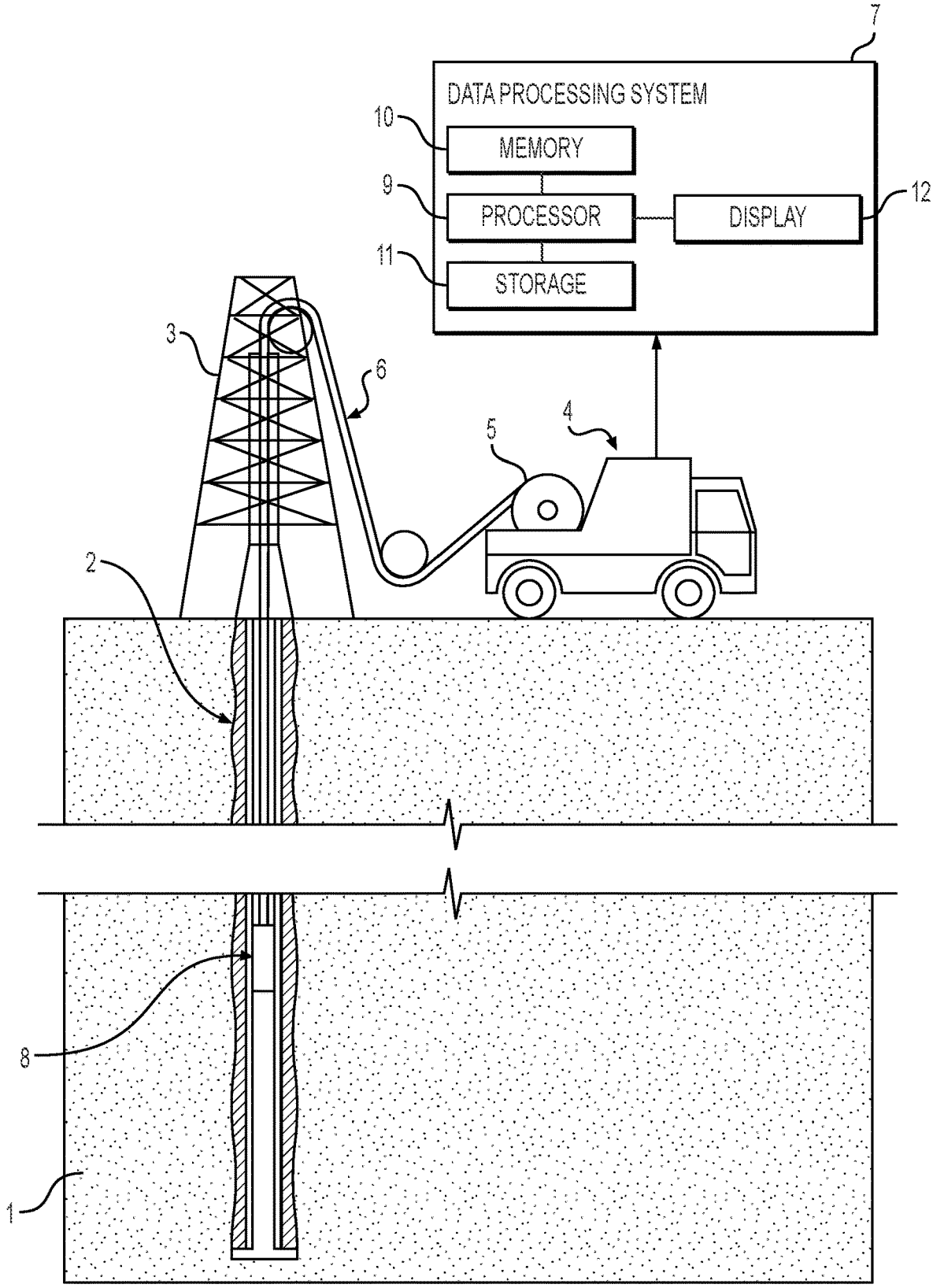
FIG. 1 is a schematic illustration of an example system for lifting well fluid to the surface.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact and may also include embodiments in which additional features may be formed interposing the first and second features, such that the first and second features may not be in direct contact.

FIG. 1 shows an exemplary well site where a debris removal tool of the present invention may be utilized. A formation 1 has a drilled and completed wellbore 2. A derrick 3 above ground may be used to raise and lower components into the wellbore 2 and otherwise assist with well operations.

A wireline surface system 4 at the ground level includes a wireline logging unit, a wireline depth control system 5 having a cable 6, and a control unit 7. The cable is connected to a connection assembly 8 that may be lowered downhole. The control unit 7 includes a processor 9, memory 10, storage 11, and display 12 that may be used to display and control various operations of the wireline surface system 4, send and receive data, and store data.

The connection assembly 8 includes equipment for mechanically and electronically connecting the debris removal tool with the cable 6. The cable 6 includes a support wire, such as steel, to mechanically support the weight of the debris removal tool and communication wire to pass communications between the debris removal tool and the wireline surface system 4. The debris removal tool, as described in more detail below, is installed below the connection assembly.

The wireline surface system 4 can deploy the cable 6, which in turn lowers the connection assembly 8 and debris removal tool deeper downhole. Conversely, the wireline surface system 4 can retract the cable 6 and raise the debris removal tool and assembly, including to the surface. The cable 6 is deployed or retracted by the wireline depth control system 5, such as by unwinding or winding the cable 6 around a spool that is driven by a motor.

The wireline logging unit communicates with the control unit 7 to send and receive data and control signals. For example, the wireline logging unit can communicate data received from the debris removal tool to the control unit 7. The wireline logging unit likewise can communicate data and control signals received from the electronic control system 7 to the debris removal tool. In some examples, the wireline logging unit is part of the control unit 7. In other examples, the control unit 7 sends and receives data to and from the debris removal tool directly.

Although FIG. 1 shows the debris removal tool being operated on a cable 6, the debris removal tool can be attached to other types of conveyance systems, such as coil tubing. Any conveyance system can be used to mechanically support the debris removal tool and mechanically raise or lower it within the wellbore 2. References to a "cable" are intended to be non-limiting, instead encompassing any known conveyance system.

Figure 2:
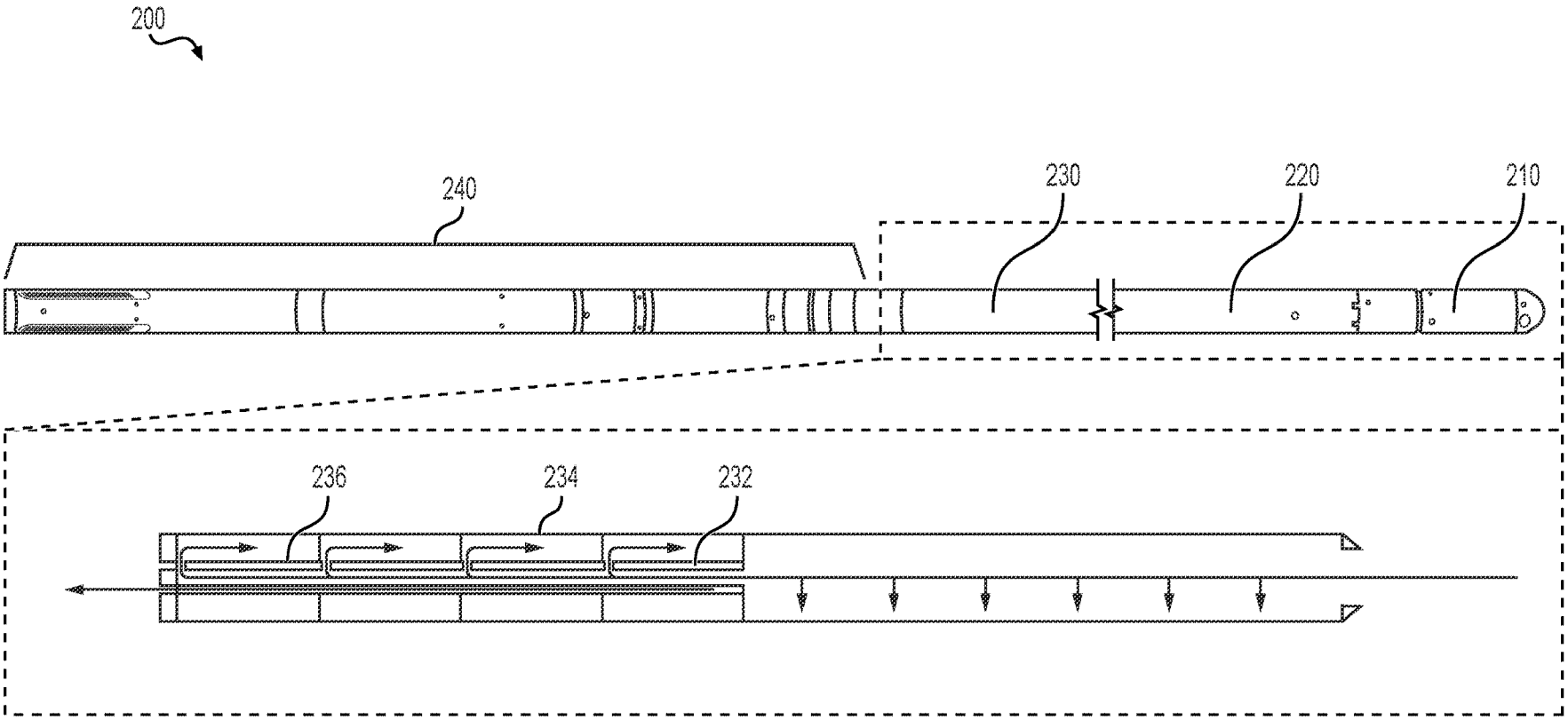
FIG. 2 is a schematic illustration of an example debris removal tool.

FIG. 2 provides a schematic illustration of an example debris removal tool 200 as described herein. The tool 200 can include various components, some of which are shown in the schematic. The tool 200 can include a check valve nose 210 that prevents backflow of fluid or debris that enters the tool 200. For example, the check valve nose 210 can be a one-way valve in which fluid can run freely into the tool 200, but the check valve nose 210 closes if the fluid begins to flow out of the tool 200. The check valve nose 210 can also prevent debris from exiting the tool 200 after entering.

The tool 200 can include a large debris bailer 220. The large debris bailer 200 can collect larger debris that enter the tool 200, such as viscous slurries and large solids. Smaller debris can be captured in a fine debris filter 230. For example, an ESP centrifugal pump 240 (referred to hereinafter as the "ESP pump 240") can generate localized circulation of the wellbore fluid for collecting settled and cohesive debris. The ESP pump 240 can include impellers that rotate about the ESP pump's 240 central axis to force the wellbore fluid through outlet openings. The ESP pump 240 can have impeller units of various types. For example, the ESP pump 240 can have any combination of mixed-flow, radial flow, and helicoaxial stage impellers. Mixed-flow is where the impeller diameter is larger than the intake diameter. As the flow comes in, water radially wraps around the pump creating both a radial flow and an axial flow, thereby creating mixed-flow. Radial flow impellers have blades that are not pitched and they usually have between 4 and 6 blades. Because of their sideways fluid motion, radial flow impellers produce a high degree of shear stress. Helicoaxial impellers are characterized by their helical or twisted blade design. The blades are twisted along their length, forming a helical shape. This design helps in achieving a balance between axial and radial flow. The helical flow pattern generated by the impeller promotes effective mixing of fluids. It is also capable of pumping the fluid in the axial direction, making it suitable for applications where both mixing and pumping are essential.

The ESP pump 240 can include multiple centrifugal stages that are stacked in series. An ESP pump has numerous advantages over other pump types. For example, an ESP pump can deliver a much higher flow rate at a particular operating speed in comparison to other pump types, such as PCPs. This can allow the tool 200 to move larger, heavier debris into the large debris bailers 220. An ESP pump can generate higher discharge pressure, thereby allowing it to push the downhole fluid into a circulating motion through the debris collector. The flow passage of centrifugal stages is made of metal as compared to the elastomeric stator of the PCP, which increases the tool life and consequently the economic return of the tools. ESP pumps have low startup torque compared to PCPs, which can reduce the chance of lock-up if left sitting idle for an extended period of time. ESP pumps also do not require multiple rotor sizes to accommodate different wellbore pressure and temperature environments.

The ESP pump 240 can connect directly to a motor. The motor can run at any appropriate speed, such as 4000-5000 rotations per minute ("RPM"). The ESP pump 240 can include a rotor shaft that connects to an intermediate shaft via a coupling. The intermediate shaft can pass through a piston rod of a compensator and connect to a first stage gearbox. The tool can include multiple gearboxes that reduce the speed and increase torque as required by the milling operation. The output shaft from the last gearbox can connect to the fine debris filter 230 shaft, which then connects to the large debris filter 220, and the milling bit via the check valve nose 210. The shaft rotating inside the filters 220, 230 is always in the clean fluid which prevents any power loss due to friction from debris.

The circulation created by the ESP pump 240 can pull wellbore fluid with the fine debris into the fine debris filter 230. The fine debris filter 230 can include a tube 232 that the wellbore fluid and fine debris travel through. The fine debris filter 230 can also include filters 234 that capture the fine debris. Fine debris captured by a filter 234 can be retained in housing components 236 during the run.

The tool 200 can also include an electronics cartridge (not shown) that includes various electronic components, such as a control unit, sensors, relays, and connectors. In some examples, the electronics cartridge can also include an electric motor. The tool 200 can further include a communication cartridge (not shown) that sends communications to, and receive communications from, a control unit at the surface, such as the control unit 7 of FIG. 1. An example of such communications can include instructions to carry out a particular operation in the wellbore.

In one example, the tool 200 can include one or more tension sensors that measure cable tension. The tool 200 can include also a tractor cartridge (not shown) that can be used to move the tool 200 along a wellbore. For example, the tractor cartridge can include slidable components that grip the inner surface of the wellbore and actuate to move the tool 200 as a whole. The tool 200 can also include an anchor module (not shown) that, when extended, engages one or more anchors into the sidewall of the wellbore. The anchor module can be powered by an electric motor within the module, for example. The anchor module can extend anchors such that they center the tool 200 within the wellbore, such as by contacting the sidewalls at two or more locations with different anchor components. In some examples, hydraulic pressure is used to extend the anchor and maintain sufficient pressure. This design of bailer shaft allows for multiple bailers/filters to be connected to each other without any additional coupling. The milling bit can be a reverse circulation design allowing for the debris to pass through it as it enters the bailer.

Various sensors can be included in the tool 200, such as sensors for flow rate, temperature, fluid pressure, cutting pressure, electrical power and current, cutting head torque, rotary motor position, anchor force, anchor position, and so on. Any of all of these sensors can be configured to send data to a control unit above ground, either directly or by sending the data to a communication module on the tool 200 that communicates with the control unit.

By adopting different types of centrifugal stages, different flow rates and discharge pressures can be achieved. Additionally, stage geometries, such as mixed flow or helico-axial stages, have better gas-handling capacity, which can enable the tool 200 to be deployed in more challenging environment.

Figure 3:
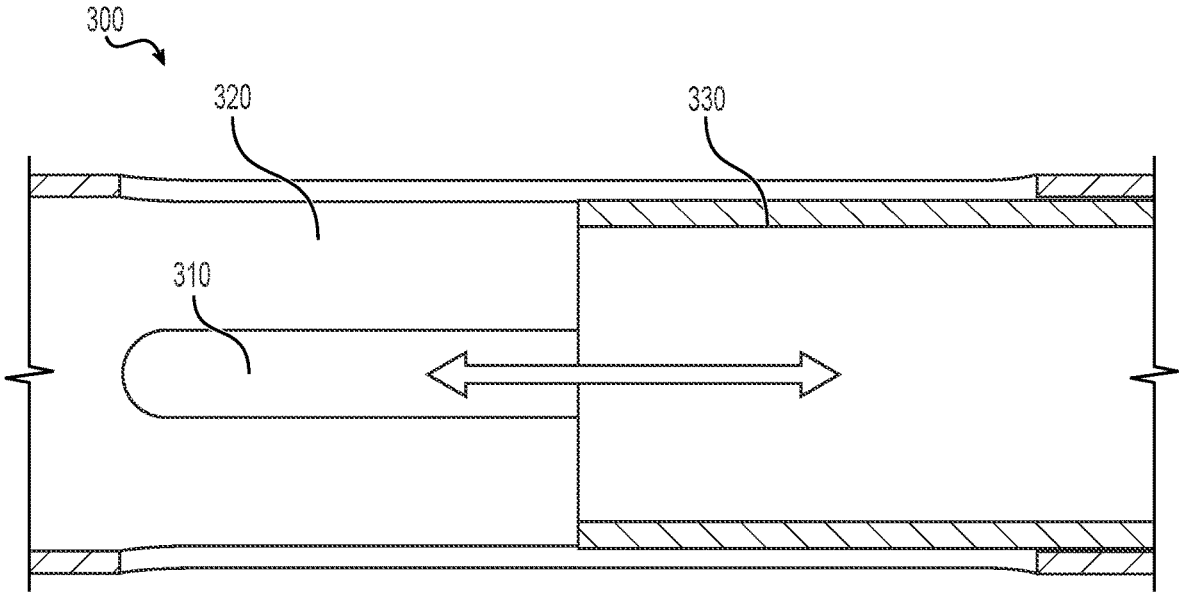
FIG. 3 is a schematic illustration of an example flow control mechanism for a debris removal tool.
Figure 4:
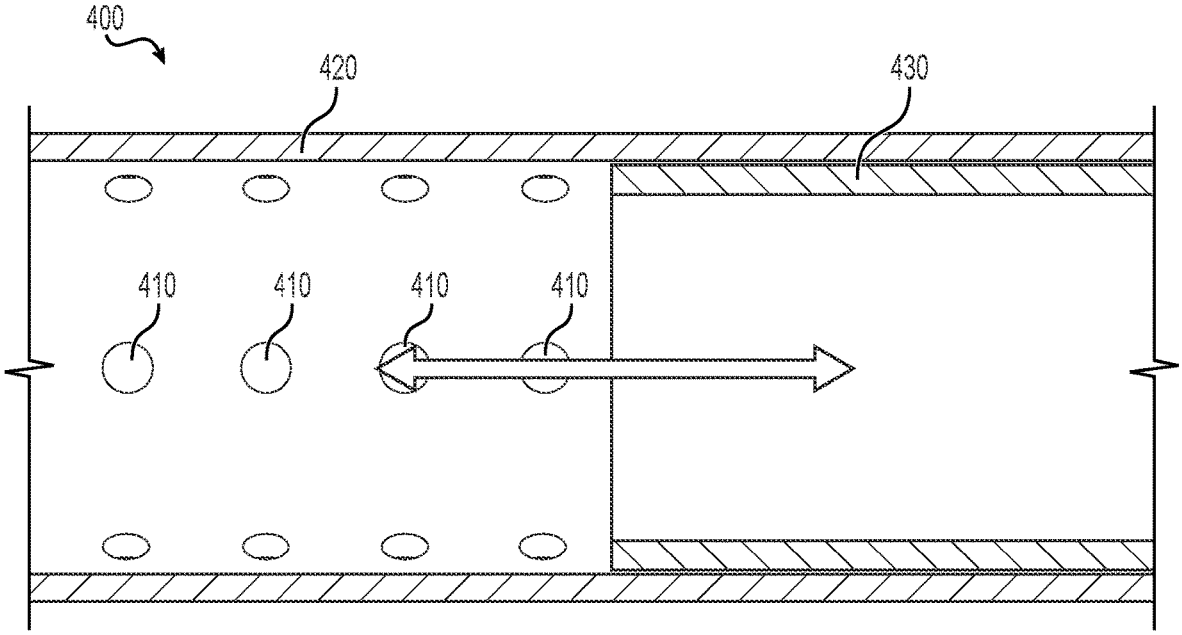
FIG. 4 is a schematic illustration of another example flow control mechanism for a debris removal tool.
Figure 5:
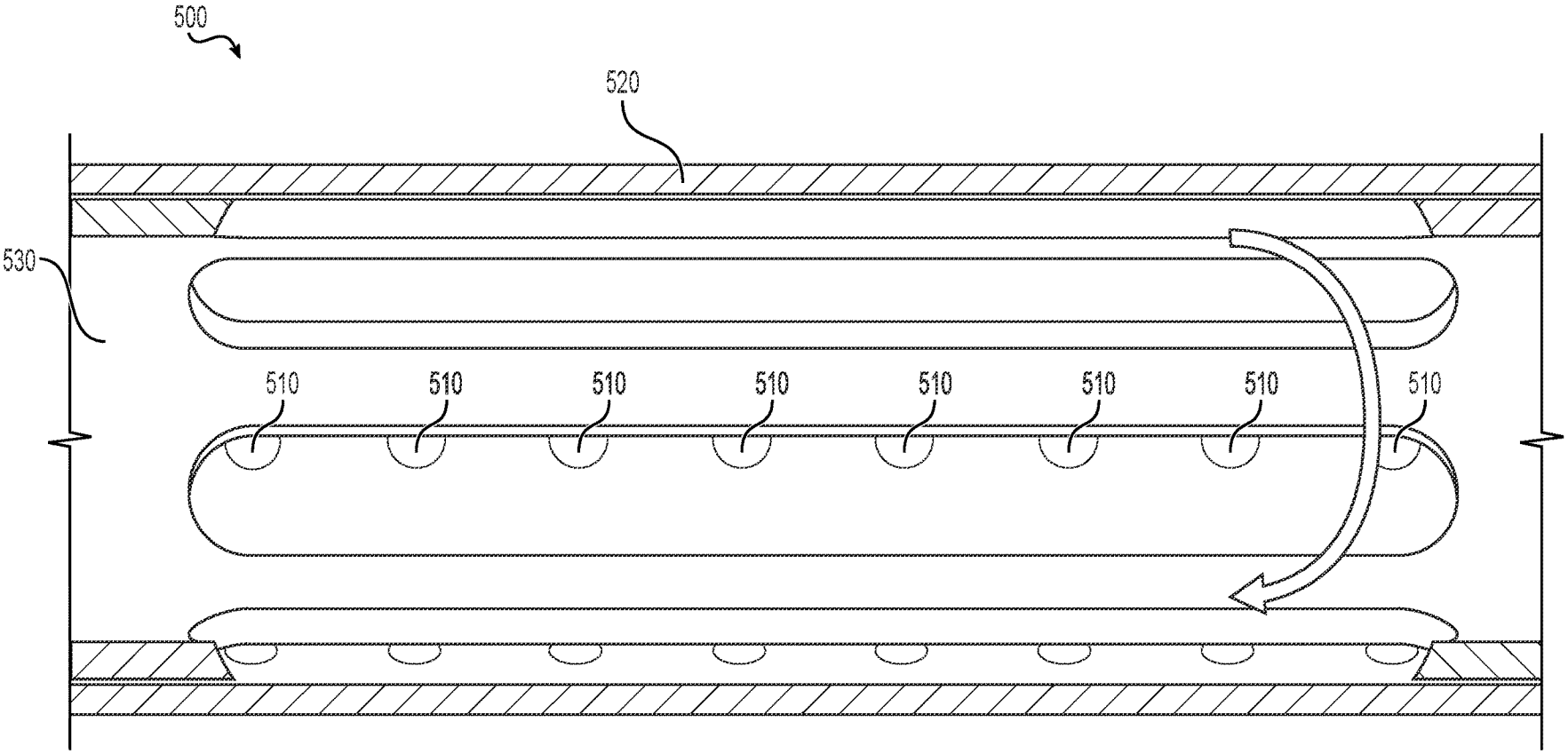
FIG. 5 is a schematic illustration of another example flow control mechanism for a debris removal tool.

The flow rate for ESP pumps is a function of both the operating speed and permissible flow area at pump output. As a result, a downhole flow control may be required in certain circumstances. FIGS. 3, 4, and 5 illustrate examples of such downhole flow controls mechanisms.

FIG. 3 illustrates a downhole flow control mechanism 300 that includes a linear cut slot 310 on the discharge housing 320 or adaptor. The linear cut slot 310 can serve as a discharge port. The total flow area can be adjusted by actuating a linear movement sleeve 330 via the use of a linear motor (not shown) to cover a portion of the linear cut slots 310. For example, total flow area can be reduced by adjusting the linear movement sleeve 330 to cover more of the linear cut slot 310, thereby reducing the amount of wellbore fluid that can pass through the linear cut slot 310. For the same reason, the total flow area can be increased by adjusting the linear movement sleeve 330 to cover less of the linear cut slot 310. The linear movement sleeve 330 can be rotated using any kind of appropriate motor, such as a linear motor (not shown).

FIG. 4 illustrates a downhole flow control mechanism 400 that includes rows of discharge openings 410 evenly distributed on the circumference of the discharge housing 420 or adaptor. The discharge openings 410 can serve as discharge ports. The total flow area can be adjusted by actuating a linear movement sleeve 430 to cover more or fewer discharge openings 410. For example, total flow area can be reduced by adjusting the linear movement sleeve 430 to cover more of the discharge openings 410, thereby reducing the amount of discharge openings 410 available for the wellbore fluid to pass through. For the same reason, the total flow area can be increased by adjusting the linear movement sleeve 430 to cover fewer discharge openings 410. The linear movement sleeve 430 can be rotated using any kind of appropriate motor, such as a linear motor (not shown).

FIG. 5 illustrates a downhole flow control mechanism 500 that includes rows of discharge openings 510 evenly distributed on the circumference of the discharge housing 520 or adaptor. The discharge openings 510 can serve as discharge ports. The total flow area can be adjusted by rotating a rotating sleeve 530 to cover more or less of each of the discharge openings 510. For example, total flow area can be reduced by adjusting the rotating sleeve 530 to cover more of each discharge opening 510, thereby reducing the amount of wellbore fluid that can pass through each discharge opening 510. For the same reason, the total flow area can be increased by adjusting the rotating sleeve 530 to cover less of each of the discharge openings 510. The rotating sleeve 530 can be rotated using any kind of appropriate motor, such as a stepper motor (not shown).

Figure 6:
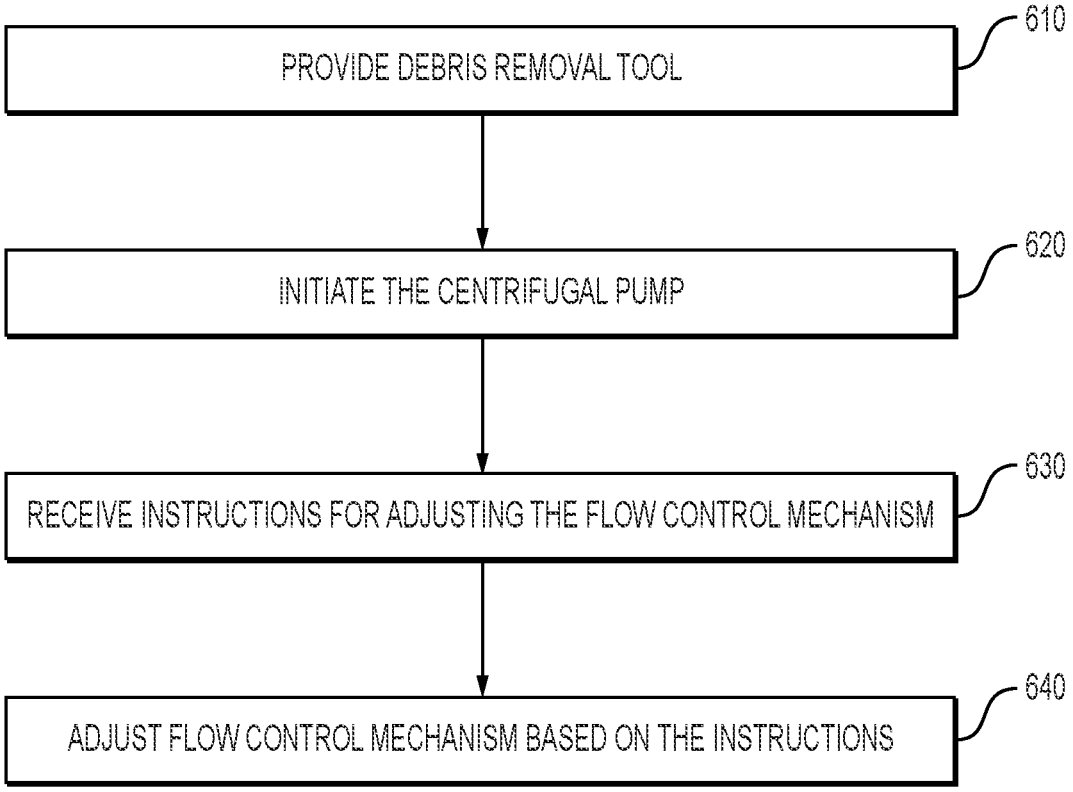
FIG. 6 is a flow chart of an example method for performing debris removal.

FIG. 6 provides a flow chart of an example method for performing a debris removal operation within a wellbore. At stage 610, a debris removal tool can be provided as described herein. For example, the debris removal tool can include a check valve nose, a large debris bailer, a fine debris filter, and an ESP pump. In one example, the ESP pump can be an ESP pump. The ESP pump can include a flow control mechanism for adjusting the flow rate of wellbore fluid. The debris removal tool can also include a flow rate sensor that measures the flow rate of wellbore fluid. The debris removal can include other components as well, such as an anchor for securing the debris removal within the wellbore to perform the debris removal operation.

At stage 620, the debris removal tool can initiate the ESP pump. Activating the ESP pump can cause wellbore fluid to begin entering the debris removal tool through the check valve nose. Large debris in the wellbore fluid, such as viscous slurries and large solids can be caught in the large debris bailer. The check valve nose can prevent the debris from reentering the well. Finer debris can be pulled into the fine debris filter. The fine debris filter can include a tube that the wellbore fluid and fine debris travel through. Debris that reaches this tube can be caught by one or more filters and retained in a housing component.

At stage 630, the debris removal tool can receive instructions for adjusting the flow control mechanism. The instructions can be provided in response to the wellbore fluid flow rate being outside of predetermined parameters, such as the flow rate being too high or too low. In one example, a sensor can measure the flow rate and report the flow rate to a control unit. The control unit can compare the flow rate to the predetermined parameters. If the flow rate falls outside the allowable parameters, the control unit can send instructions to the debris removal tool for increasing or decreasing the flow rate as appropriate. Alternatively, the control unit can display the flow rate on a display that a user can read. The user can manually adjust the flow rate at the control unit, and the control unit can send corresponding instructions to the debris removal tool.

At stage 640, the debris removal tool can adjust flow control mechanism based on the instructions. The manner in which the debris removal tool adjusts the flow control mechanism can depend on the type of flow control mechanism. For example, the flow control mechanism can include a discharge housing with one or more discharge openings, a movement sleeve, and a motor that repositions the movement sleeve to cover more or less of the discharge openings to adjust the flow rate. The flow control mechanism can activate the motor based on the flow control mechanism type.

As an example, if the discharge opening includes a linear cut slot, such as with the flow control mechanism 300 illustrated in FIG. 3, then a linear motor can be activated to move the movement sleeve linearly within the discharge housing. To increase the flow rate, the linear motor can move the movement sleeve so that it covers less of the linear cut slot, thereby allowing more wellbore fluid to flow through the linear cut slot. To decrease flow rate, the linear motor can move the movement sleeve so that it covers more of the linear cut slot, thereby allowing less wellbore fluid to flow through the linear cut slot.

In another example, the discharge sleeve of the flow control mechanism can include multiple discharge openings and a linear movement sleeve, such as with the flow control mechanism 400 illustrated in FIG. 4. To increase the flow rate, the linear motor can move the movement sleeve so that it covers fewer of the discharge openings. To decrease flow rate, the linear motor can move the movement sleeve so that it covers more of the discharge openings.

In another example, the movement sleeve can be a rotating sleeve, such as with the flow control mechanism 500 illustrated in FIG. 5. The discharge sleeve can include one or more sets of aligned discharge openings. The rotating sleeve can include linear cut slots that align with the discharge openings. To increase the flow rate, a stepper motor can rotate the rotating sleeve so that it covers a smaller portion of the discharge openings. To decrease flow rate, the stepper motor can rotate the rotating sleeve so that it covers a greater portion of the discharge openings.

Figure 7:
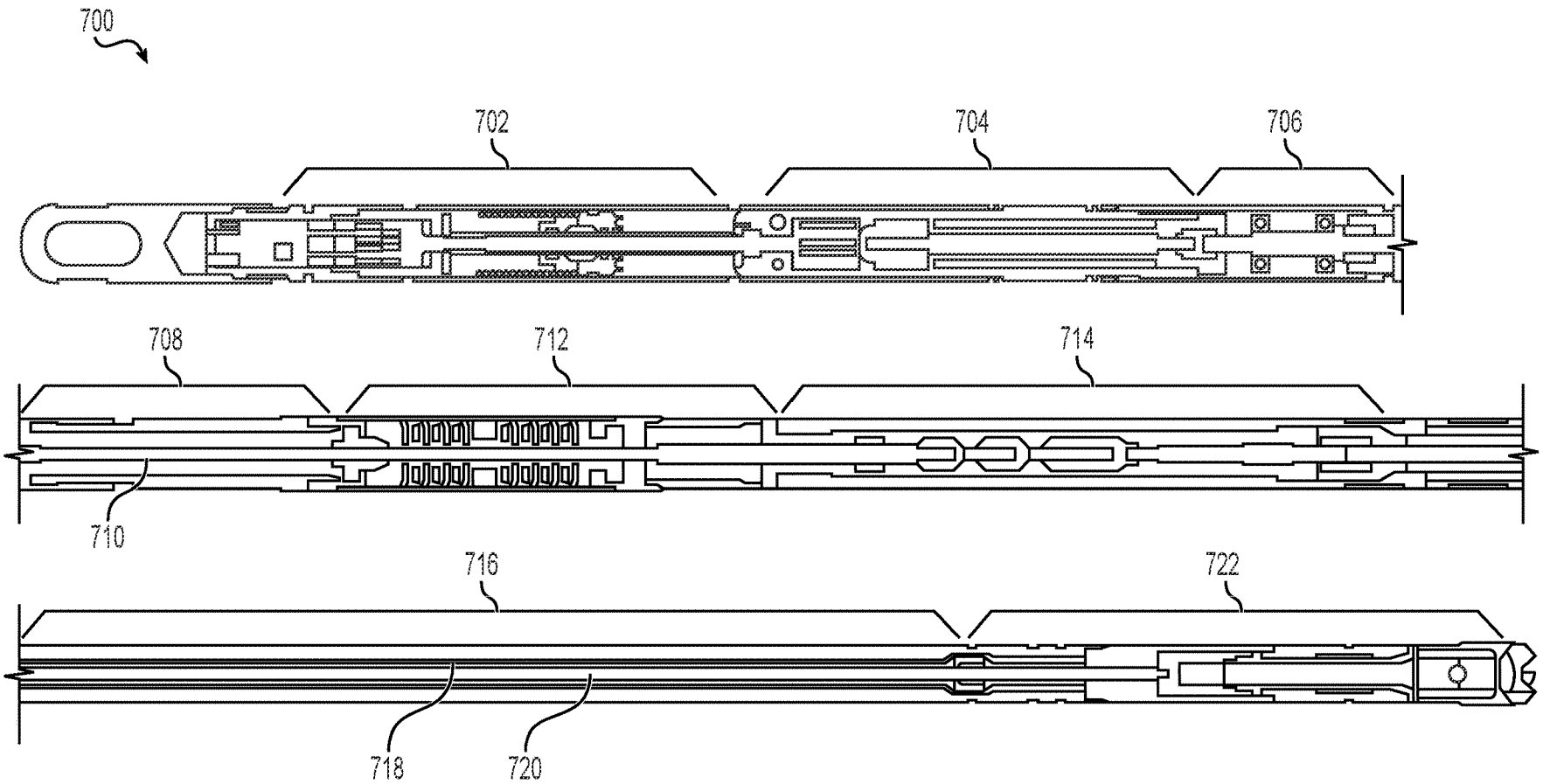
FIG. 7 is schematic illustration of another example debris removal tool.

FIG. 7 is schematic illustration of another example debris removal tool 700. The debris removal tool 700 includes a centrifugal pump 712 that is driven by an electric motor 704. A compensator 702 can be positioned uphole of the motor 704 and stabilize the tool 700 from the effects of movement or vibrations. The motor 704 can drive the centrifugal pump 712 by rotationally driving an upper shaft 710 that is coupled to the centrifugal pump 712. The tool 700 can include bearings 706 that support and guide the rotating components (e.g., the upper shaft 710) of the drill string as it drills into the subsurface. The upper shaft 710 can be enclosed in a housing 708 to protect it from the subsurface environment. The upper shaft 710 passes through the centrifugal pump 712 and connects to a gearbox 714 that lowers speed and increases torque. The gearbox 714 can be coupled to the upper shaft 714 on its uphole end and to a lower shaft 720 on its downhole end. The lower shaft 720 passes through a bailer 716 to a milling bit 722. The milling bit 722 can be a flow-through bit that allows fluids and debris to pass through into the tool 700. The series of shafts 710, 720 coupled to the gear box 714 allow the electric motor to drive the centrifugal pump 712 and the milling bit 722 simultaneously at different speeds and torques.

The tool 700 can have additional shafts beyond the upper and lower shafts 710, 720. For example, the upper shaft 710 and lower shaft 720 can be series of shafts coupled to each other with the upper series of shafts being uphole of the gear box 714 and the lower series of shafts being downhole of the gearbox 714. The upper series of shafts can be driven by the motor 704 at a first speed and torque, and the lower series of shafts can be driven at a second speed and torque due to the gear box 714. As an example, the motor 704 can drive a first upper shaft that passes through the bearings 706 and coupled to a second upper shaft that passes through the housing 708. The second upper shaft can be coupled to a third upper shaft that passes through and drives the centrifugal pump 712 and connects to the gearbox 714. On the downhole side of the gearbox a first lower shaft can be coupled to the downhole end of the gearbox at one end and pass through the bailer 716. The first lower shaft can be coupled to a second lower shaft that drives the milling bit. The shafts can be rotatably coupled together using a coupling mechanism that permits relative bending at the coupling point to account for nonlinear wellbore conditions.

The tool 700 can be conveyed via wireline tractor to the position in the well. When an obstruction blocking the well is reached, tool 700 is activated. Drilling fluid is pumped into the well and the electric motor 704 is activated. The centrifugal pump 712 pumps the water out into the wellbore while the milling bit loosens the obstruction. The centrifugal pump 712 creates a suction that pulls the drilling fluid and debris from the obstruction through the milling bit 722 and into the bailer 716 that includes filters 718. The filters 718 separate the debris from the drilling fluid, and the debris is captured inside the filters 718. The filtered drilling fluid gets pumped back into the wellbore through the outlet of the centrifugal pump 712, and then circulates back into the tool 700 through the milling bit 722.

What is claimed is:

1. A debris removal tool for simultaneously milling and removing debris, comprising:

a check valve nose including a pass-through milling bit;
a debris bailer coupled to the check valve nose at a first end of the debris bailer;
a debris filter coupled to a second end of the debris bailer at a first end of the debris filter, the debris filter configured to capture first debris smaller than second debris captured by the debris bailer;
a gearbox coupled to a second end of the debris bailer at a first end of the gearbox;
a centrifugal pump coupled to a second end of the gearbox; and
a flow control mechanism coupled to the centrifugal pump.

2. The debris removal tool of claim 1, wherein the centrifugal pump includes at least one of a mixed flow impeller, a radial flow impeller, or a helicoaxial impeller.

3. The debris removal tool of claim 1, further comprising:
a motor coupled to the centrifugal pump through a first shaft;
a second shaft rotatably coupled to the first shaft, wherein the first shaft passes through the centrifugal pump and is coupled to a first end of the gearbox; and
a third shaft coupled to a second end of the gear box at a first end of the third shaft and to a milling bit at a second end of the third shaft.

4. The debris removal tool of claim 3, wherein the gearbox causes the third shaft to rotate at a lower speed and higher torque than the first shaft and the second shaft.

5. The debris removal tool of claim 1, wherein the centrifugal pump is an electrical submersible pump.

6. The debris removal tool of claim 1, wherein the flow control mechanism comprises:
a discharge housing, the discharge housing including multiple discharge openings distributed on a circumference of the discharge housing;
a movement sleeve, the movement sleeve covering one or more of the multiple discharge openings; and
a motor, that when activated, repositions the movement sleeve relative to the discharge housing to change how many of the multiple discharge openings are covered by the movement sleeve.

7. The debris removal tool of claim 1, wherein the flow control mechanism comprises:
a discharge housing, the discharge housing including a cut slot,
a movement sleeve, the movement sleeve covering at least a portion of the cut slot, and
a motor that, when activated, repositions the movement sleeve relative to the discharge housing to change the portion of the cut slot covered by the movement sleeve.

8. A system for simultaneously milling and removing debris within a wellbore, comprising:
a debris removal tool, comprising:
a check valve nose including a pass-through milling bit;
a debris bailer coupled to the check valve nose at a first end of the debris bailer;
a debris filter coupled to a second end of the debris bailer at a first end of the debris filter, the debris filter configured to capture first debris smaller than second debris captured by the debris bailer;
a gearbox coupled to a second end of the debris bailer at a first end of the gearbox;
a centrifugal pump coupled to a second end of the gearbox; and
a flow control mechanism coupled to the centrifugal pump;
a cable configured to lower the debris removal tool within the wellbore;
a flow rate sensor configured to measure flow through the debris removal tool;
a control unit that receives data from the flow rate sensor; and
a display device that displays a visualization of the data from the flow rate sensor.

9. The system of claim 8, wherein the centrifugal pump includes at least one of a mixed flow impeller, a radial flow impeller, or a helicoaxial impeller.

10. The system of claim 8, wherein the debris removal tool further comprises:
a motor coupled to the centrifugal pump through a first shaft;
a second shaft rotatably coupled to the first shaft, wherein the first shaft passes through the centrifugal pump and is coupled to a first end of the gearbox; and
a third shaft coupled to a second end of the gear box at a first end of the third shaft and to a milling bit at a second end of the third shaft.

11. The system of claim 10, wherein the gearbox causes the third shaft to rotate at a lower speed and higher torque than the first shaft and the second shaft.

12. The system of claim 8, wherein the centrifugal pump is an electrical submersible pump.

13. The system of claim 8, wherein the flow control mechanism comprises:
a discharge housing, the discharge housing including multiple discharge openings distributed on a circumference of the discharge housing;
a movement sleeve, the movement sleeve covering one or more of the multiple discharge openings; and
a motor, that when activated, repositions the movement sleeve relative to the discharge housing to change how many of the multiple discharge openings are covered by the movement sleeve.

14. The system of claim 8, wherein the flow control mechanism comprises:
a discharge housing, the discharge housing including a cut slot,
a movement sleeve, the movement sleeve covering at least a portion of the cut slot, and
a motor that, when activated, repositions the movement sleeve relative to the discharge housing to change the portion of the cut slot covered by the movement sleeve.

15. A method for simultaneously milling and removing debris within a wellbore, comprising:
providing a debris removal tool within a wellbore, the debris removal tool comprising:
a check valve nose including a pass-through milling bit;
a debris bailer coupled to the check valve nose at a first end of the debris bailer;
a debris filter coupled to a second end of the debris bailer at a first end of the debris filter, the debris filter configured to capture first debris smaller than second debris captured by the debris bailer;
a gearbox coupled to a second end of the debris bailer at a first end of the gearbox;
a centrifugal pump coupled to a second end of the gearbox;
a flow control mechanism coupled to the centrifugal pump; and
a motor coupled to the centrifugal pump;
pumping drilling fluid into the wellbore; and
initiating the motor.

16. The method of claim 15, wherein the centrifugal pump includes at least one of a mixed flow impeller, a radial flow impeller, or a helicoaxial impeller.

17. The method of claim 15, the debris removal tool further comprising:

a first shaft rotatably coupled to the motor at a first end and rotatably coupled to the centrifugal pump at a second end;

a second shaft rotatably coupled to the first shaft, wherein the first shaft passes through the centrifugal pump and is coupled to a first end of the gearbox; and a third shaft coupled to a second end of the gear box at a first end of the third shaft and to a milling bit at a second end of the third shaft.

18. The method of claim 17, wherein the gearbox causes the third shaft and the pass-through milling bit to rotate at a lower speed and higher torque than the first shaft and the second shaft.

19. The method of claim 15, wherein the centrifugal pump is an electrical submersible pump.

20. The method of claim 15, further comprising:

controlling flow of the drilling fluid from the centrifugal pump into a surrounding subsurface using the flow control mechanism.

* * * * *